US009630827B2

(12) United States Patent
Bencista' Falorni

(10) Patent No.: US 9,630,827 B2
(45) Date of Patent: Apr. 25, 2017

(54) DISPENSER DEVICE OF CARBONATED BEVERAGES

(71) Applicant: ENOMATIC S.R.L., Greve in Chianti (IT)

(72) Inventor: Gianni Bencista' Falorni, Greve in Chianti (IT)

(73) Assignee: ENOMATIC S.r.l, Greve in Chianti (IT)

( * ) Notice: Subject to any disclaimer, the term of this patent is extended or adjusted under 35 U.S.C. 154(b) by 0 days.

(21) Appl. No.: 14/758,651

(22) PCT Filed: Dec. 20, 2013

(86) PCT No.: PCT/IB2013/061210
§ 371 (c)(1),
(2) Date: Jun. 30, 2015

(87) PCT Pub. No.: WO2014/106791
PCT Pub. Date: Jul. 10, 2014

(65) Prior Publication Data

US 2015/0375982 A1 Dec. 31, 2015

(30) Foreign Application Priority Data

Jan. 2, 2013 (IT) ..... FI2013A0001

(51) Int. Cl.

| | |
|---|---|
| ***B67D 1/04*** | (2006.01) |
| ***B67D 1/08*** | (2006.01) |
| ***B67D 1/12*** | (2006.01) |
| ***B67D 1/00*** | (2006.01) |

(52) U.S. Cl.
CPC ..... *B67D 1/0412* (2013.01); *B67D 1/0004* (2013.01); *B67D 1/0406* (2013.01); *B67D 1/0884* (2013.01); *B67D 1/1272* (2013.01)

(58) Field of Classification Search
CPC .. B67D 1/0004; B67D 1/0406; B67D 1/0412; B67D 1/0884; B67D 1/1272
See application file for complete search history.

(56) References Cited

U.S. PATENT DOCUMENTS

| | | | | |
|---|---|---|---|---|
| 4,940,165 A * | 7/1990 | McMillin | B67D 1/0051 | 137/170.3 |
| 5,798,139 A * | 8/1998 | Nagashima | B05B 5/12 | 118/50.1 |
| 6,367,667 B1 * | 4/2002 | Ipsen | B67D 1/0832 | 137/212 |
| 2005/0061393 A1 * | 3/2005 | Luis | C12H 1/12 | 141/65 |
| 2010/0006603 A1 * | 1/2010 | Weinberg | B67D 1/0418 | 222/152 |

(Continued)

*Primary Examiner* — Frederick C Nicolas
*Assistant Examiner* — Bob Zadeh
(74) *Attorney, Agent, or Firm* — Abelman, Frayne & Schwab

(57) ABSTRACT

Dispenser device for automatic dispensing machines of carbonated beverages from bottles and like containers. At least one decompression chamber is associated and works together to an inert gas insufflating system in order to maintain the carbon dioxide content of the beverage after the bottle is opened, therefore keeping the original effervescence and perlage of the dispensed carbonated beverage up to complete depletion of the bottle.

10 Claims, 4 Drawing Sheets

(56) References Cited

U.S. PATENT DOCUMENTS

| | | | | |
|---|---|---|---|---|
| 2012/0285998 | A1* | 11/2012 | Peirsman | B67D 1/0412 222/396 |
| 2013/0306673 | A1* | 11/2013 | Manera | B65D 83/32 222/82 |
| 2015/0375982 | A1* | 12/2015 | Bencista' Falorni | B67D 1/0406 222/401 |

* cited by examiner

Replacement Sheet

DISPENSER DEVICE OF CARBONATED BEVERAGES

FIELD OF THE INVENTION

The present invention relates to the field of apparatuses for automatically dispensing beverages. In particular, the present invention relates to the field of apparatuses for dispensing carbonated beverages from bottles and similar vessels.

STATE OF THE ART

Apparatuses are known from the state of the art for automatically dispensing beverages from containers such as bottles and the like. Some of these o apparatuses are such that the bottles or the similar vessels are kept in overturned position and dispense the beverage therein contained by means of the suitable opening of a valve which allows the fall by gravity of the beverage into a container conveniently positioned at the mouth of the vessel.

Others provide the bottles, or the similar vessels, to be kept in vertical position, resting on the bottom thereof, and dispensing the beverage by means of two tubes introduced into the bottle through the bottle cap. An inert gas is blown inside the bottle through one of the aforesaid tubes thus keeping the beverage pressurized.

When the dispensing tap associated with a tube is opened, the pressurized gas allows the dispensing of the beverage through the other tube. Apparatuses of this second type are particularly suitable in all those cases when, for example in the case of wine, the beverage contained in the bottle would inevitably undergo a decline in the organoleptic quality thereof due to contact with the oxygen in the air and due to the overturned position of the bottle.

However, automatic dispensing apparatuses of beverages available in the state of the art are not suitable for maintaining the typical effervescence or perlage of carbonated beverages. It is thus apparent that for this reason, the devices and automatic dispensing apparatuses of beverages available in the state of the art cannot be used with aerated or carbonated beverages, whether or not a drink is being dispensed or a vintage champagne is being dispensed.

Indeed, especially in the case of champagne, sparkling wine and carbonated wines, the effervescence and the perlage are necessary characteristics of the beverage and any automatic dispenser should necessarily provide to keep it intact even after the bottle has been opened and the contents thereof have started to be dispensed.

Therefore, an object of the present invention is the introduction of a new dispenser device for automatic dispensing apparatuses of carbonated beverages from containers such as bottles and the like, adapted to keep intact the effervescence and perlage thereof up to the dispensing of the last glass. Therefore, the dispenser device in accordance with the present invention comprises a dispenser block for automatic dispensing apparatuses of carbonated beverages, comprising means adapted to maintain the effervescence and the organoleptic characteristics of the beverage over time, after the opening of the container or the bottle, which are sufficient to dispense the entire contents of said container.

SUMMARY OF THE INVENTION

Figure 1:
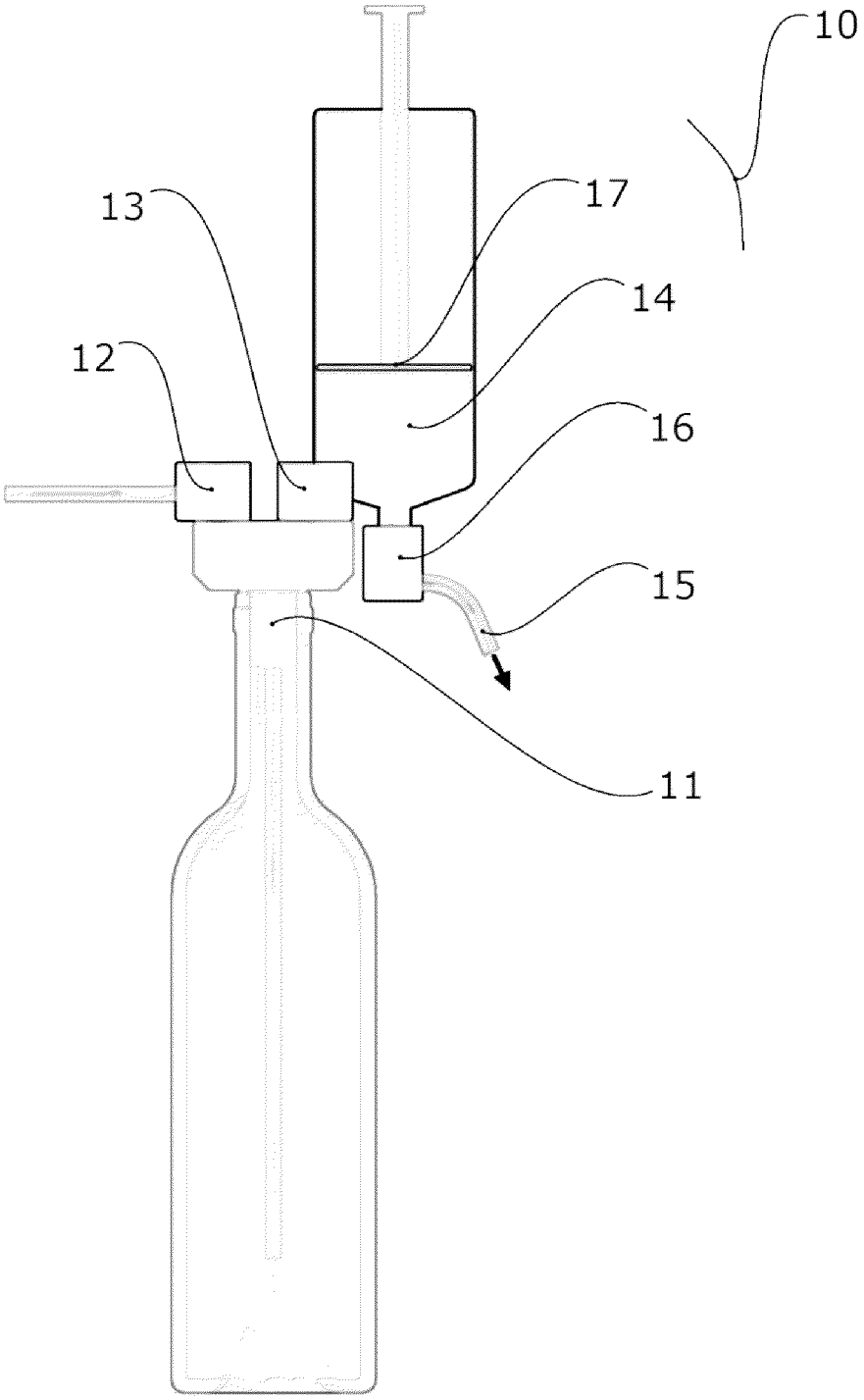
FIG. 1 shows a first preferred embodiment of the present invention comprising a single decompression chamber.

The present invention relates to a dispenser device for automatic dispensing apparatuses of carbonated beverages from vessels such as bottles and the like, characterized in that it has one dispensing block comprising at least one decompression chamber and means adapted to dispense by means of blowing inert gas, so as to keep intact the effervescence and the perlage of said carbonated beverage up to complete depletion.

DETAILED DESCRIPTION OF THE INVENTION

In reference to the accompanying drawings, the dispenser device according to the present invention comprises a tap block 10, adapted to engage the opening of a bottle or similar vessel for beverages and to adjust the outlet of the beverage contained therein. Said tap block 10 comprises an inlet spout 11 adapted to engage the opening of the bottle or the vessel, said inlet spout 11 comprising a first channel adapted to blow gas into said bottle or said vessel and a second channel adapted to extract the beverage from inside said bottle or said vessel.

Said first channel is associated with means for dispensing gas by means of a valve 12, for example a simple check valve or a controlled valve, while said second channel is associated with means for dispensing said beverage by means of a first solenoid valve 13, said dispensing means comprising at least one decompression chamber 14 associated with a dispensing spout 15 by means of a second solenoid valve 16.

Said solenoid valves may be possibly replaced by suitable flow interruption means. Thus in the present description, the term solenoid valve means generic means for controlling the interruption of liquid or gaseous flow.

In a first preferred embodiment of the present invention, shown in accompanying FIG. 1, said decompression chamber 14 comprises a piston 17, the movement of Is which within said decompression chamber 14 is controlled by means of suitable actuation means and is adapted to vary the inner volume of said decompression chamber 14 in the various operating steps of the present invention.

Advantageously, said inlet spout 11 may be associated with means for measuring the inner pressure of the bottle or the vessel containing the beverage to be dispensed.

Said tap block 10 is also associated with a suitable control module in turn associated with said suitable actuation means, with said gas dispensing means and, when present, with said means for measuring the inner pressure of the bottle or the vessel containing the beverage to be dispensed, and is adapted, among other things, to control the dispensing of the beverage, on the basis of the requests and the settings of the user, which are supplied by means of the user interface of the automatic dispensing apparatus of beverages into which said tap block 10 is inserted.

When the bottle is inserted in the automatic dispensing apparatus of beverages comprising the device according to the present invention, and said inlet spout 11 is inserted into the mouth of said bottle, said control module allows the performance of the following actions: the adjustment of the inlet of gas into the bottle so as to equal the pressure initially measured, inside the bottle, by the pressure measuring means, when present, or so as to achieve a reset pressure value close to the pressure value normally present inside the closed bottle; the opening of said first solenoid valve 13 and, simultaneously, the raising of said piston 17 by means of said actuator means, so as to increase the inner volume of said decompression chamber 14. Thereby, the increase of the volume in said decompression chamber 14 compensates for the pressure of the beverage inside the bottle and the beverage, by virtue of the pressure thereof, rises inside said decompression chamber 14 in the intended quantity. When the pressure in said decompression chamber 14 equals approximately the pressure inside the bottle, said control module closes said first solenoid valve 13.

Then, said control module, by means of actuator means, further increases the volume in said decompression chamber 14, thus further lifting said piston 17, and then opens said second solenoid valve 16 while simultaneously lowering said piston 17 to promote the dispensing of the beverage present inside said decompression chamber 14 though said dispensing spout 15.

Thereby, the carbonated beverage will be dispensed without losing its carbon dioxide content and without generating foam, thus maintaining all the characteristics of the beverage as though it had been directly poured from the bottle.

At the end of dispensing, the carbon dioxide separated from the beverage due to the decompression described above, may be ejected, by means of said second solenoid valve 16 and said dispensing spout 15, due to the effect of a further lowering of said piston 17 until reducing the volume in said decompression chamber 14 to zero. The expulsion of said carbon dioxide advantageously allows said dispensing spout 15 to be cleaned of any beverage residues which may contaminate subsequent dispensing.

The present inventions allows the beverage to be dispensed while keeping the pressure inside the bottle approximately constant, thus keeping almost intact the carbon dioxide content of the beverage inside the bottle up to the complete dispensing thereof. The beverage may thus be dispensed at subsequent times without the characteristics thereof being altered. The carbon dioxide content of the aerated beverage measured before and after the dispensing by means of the device according to the present invention indeed shows a negligible variation and such as not to affect the aspect and organoleptic characteristics of the beverage.

In a second preferred embodiment of the present invention, said first and said second solenoid valve 13, 16 may be advantageously integrated in a single multiple solenoid valve.

Figure 2:
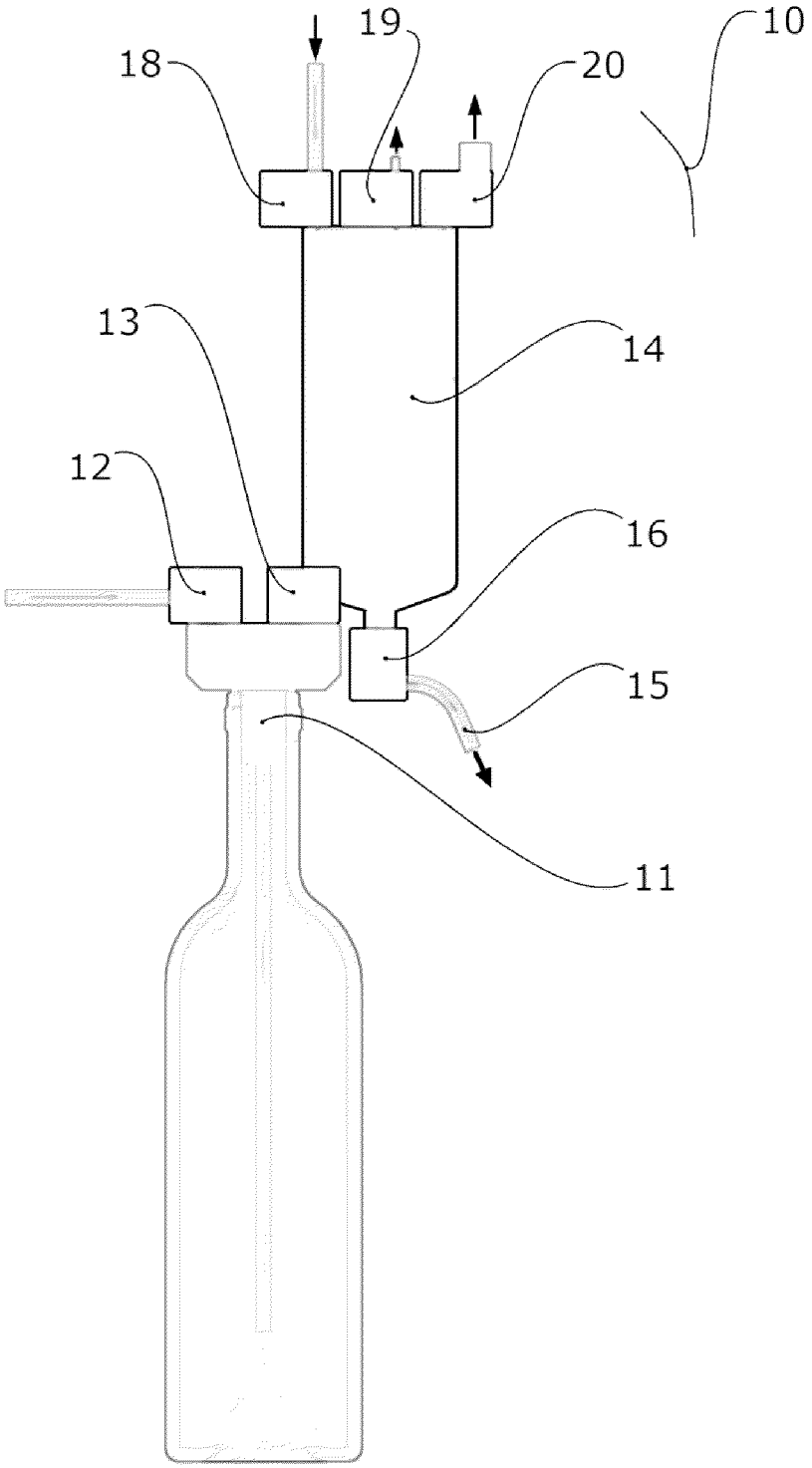
FIG. 2 shows a third preferred embodiment of the present invention comprising a single decompression chamber.

In a third preferred embodiment of the present invention, shown in accompanying FIG. 2, said decompression chamber 14 comprises, instead of said piston 17, a third solenoid valve 18 which connects the inner volume of said decompression chamber 14 to said gas dispensing means, a fourth solenoid valve 19 and a possible fifth solenoid valve 20 arranged, when they are open, so as to put the inside of said decompression chamber 14 into communication with the outside.

The fourth solenoid valve 19 is adapted to operate as a relief, i.e. when open, is adapted to allow a gradual lowering of the inner pressure of said decompression chamber 14. Said possible fifth solenoid valve 20 is instead adapted to operate, when open, so as to rapidly lower the inner pressure of said decompression chamber 14.

Said third and said fourth solenoid valve 18, 19, or said third, fourth and fifth solenoid valve 18, 19, 20 may be advantageously integrated in a single multiple solenoid valve.

In accordance with this third preferred embodiment of the present invention, initially it is provided to open said check valve 12 while keeping said first solenoid valve 13 closed. Then said third solenoid valve 18 is opened thus emitting gas into the decompression chamber 14 up to reaching a pressure value about equal to the one inside the bottle, after said third solenoid valve 18 is closed and said first solenoid valve 13 is opened so as to put the bottle into communication with said decompression chamber 14. A this point, said fourth solenoid valve 19 is opened so as to diminish the pressure inside said decompression chamber 14 and hence generate the inlet into said chamber of a given amount of beverage from the bottle. When the quantity is reached of beverage intended to be introduced into said decompression chamber 14 and then dispensed, said second solenoid valve 13 is closed so as to "cap" the bottle again thus keeping the beverage therein contained practically at the initial pressure value thereof.

Hence, if said fifth solenoid valve 20 is present, it is opened so as to lower the value of the inner pressure of said decompression chamber 14 to the value of the outer pressure. This operation is accompanied by a noise similar to the one heard when a bottle of sparkling wine is uncorked and allows the situation to be simulated in which the dispensing immediately follows the opening of the bottle.

Finally, said second solenoid valve 16 is opened so as to dispense the quantity of beverage contained in said decompression chamber 14, through said dispensing spout 15, without any uncontrolled expansion which could cause undesired phenomena such as, for example, an excessive generation of foam during dispensing.

At the end of dispensing, by re-opening said third solenoid valve 18, it is possible to blow the gas through said dispensing spout 15 outwards so as to clean said dispensing spout 15 of any beverage residues which may contaminate subsequent dispensing.

In a fourth preferred embodiment of the present invention, said first and said second solenoid valve 13, 16 may be advantageously integrated in a single multiple solenoid valve.

To reduce the waiting times between one dispensing and the next, due to the sequence of operations described above, the present invention may advantageously employ a plurality of said decompression chambers 14.

Figure 3:
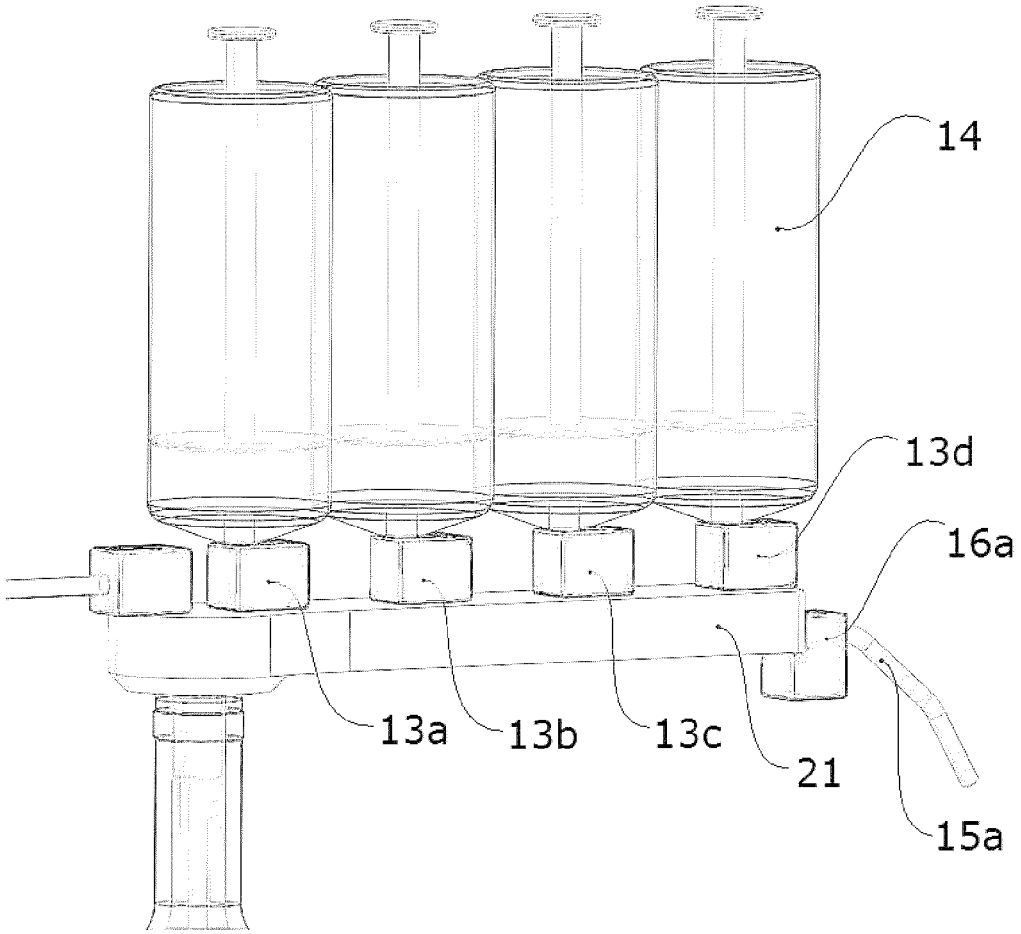
FIG. 3 shows a fifth preferred embodiment of the present invention comprising a plurality of decompression chambers.

In a fifth preferred embodiment of the present invention, shown in accompanying FIG. 3, the dispenser device according to the present invention thus comprises a plurality of said decompression chambers 14, each comprising means for adjusting the inner pressure and being associated, by means of a solenoid valve 13*a*, 13*b*, 13*c*, 13*d*, with a dispensing channel 21 and connected, in turn, to a dispensing spout 15*a* by means of a further solenoid valve 16*a*.

In this case the various decompression chambers 14 present operate in sequence thus guaranteeing a multiple number of dispensing equal to the number thereof, without waiting times. Said decompression chambers 14 may be advantageously made as described above, relative to the first four preferred embodiments of the present invention.

Figure 4:
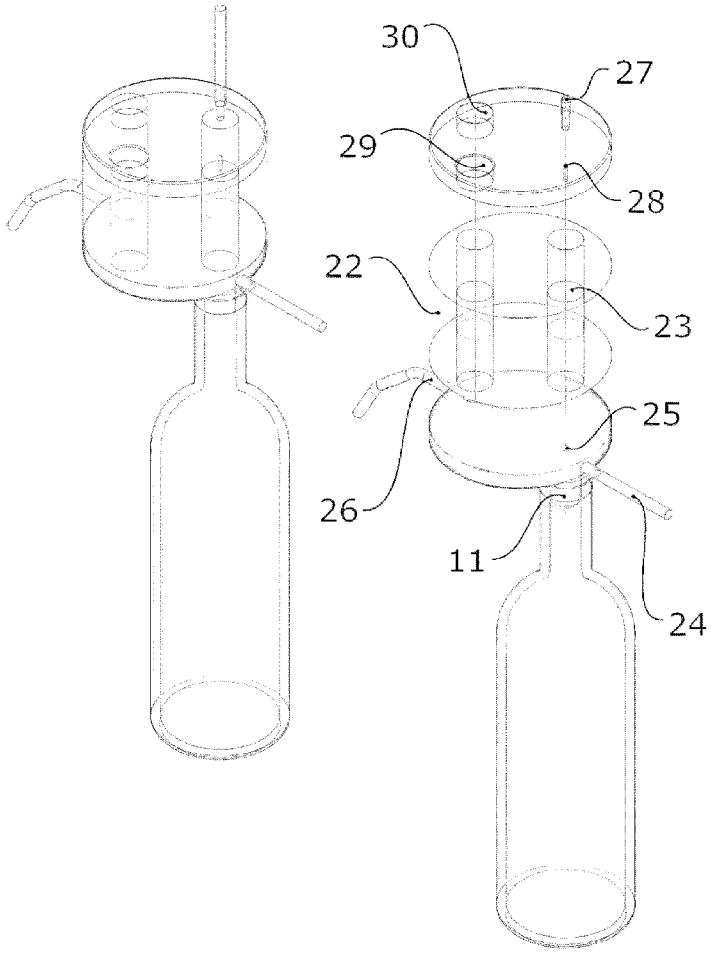
FIG. 4 shows a sixth preferred embodiment of the present invention comprising a multiple, rotating decompression chamber.

A sixth preferred embodiment of the present invention, shown in accompanying FIG. 4, provides another method for reducing the wait times between one dispensing and the next. The device according to said sixth preferred embodiment of the present invention comprises a multiple, rotating decompression chamber. Said multiple, rotating decompression chamber comprises in turn a main body 22, preferably cylindrical, associated with suitable actuating means adapted to allow the rotation thereof about the axis thereof, said main body 22 comprising in turn a plurality of decompression chambers 23 arranged on the periphery thereof and preferably, also cylindrical in shape. 4 of said decompression chambers 23 are shown in accompanying FIG. 4, but may be made in different quantities, according to the needs of use.

The lower base of said main body 22 is associated with an inlet spout 11 adapted to engage the opening of the bottle, with a gas inlet channel 24—associated with said inlet spout 11 and connected upstream to a gas inlet solenoid valve—with an opening 25 for the introduction of the beverage from the bottle and with a dispensing spout 26 of the beverage.

The upper base of said main body 22 is associated with a gas inlet channel 27 and with a breather nozzle 28, and is further provided with two openings 29, 30 of size approximately corresponding to that of said decompression chambers 23.

Said main body 22 is therefore adapted to rotate about the axis of symmetry thereof while the upper and lower bases thereof remain fixed.

In reference to accompanying FIG. 4, during the operation of the device, each of said decompression chambers 23 goes through four different operating steps corresponding to four positions taken on during the rotation of said main body 22.

In the first position, the decompression chamber 23 is closed and is in position corresponding to said gas inlet channel 24; said control module activates the solenoid valve upstream of said gas inlet channel 24 so as to blow gas into said compression chamber until reaching approximately the one in the bottle.

In the second position, the decompression chamber 23, pressurized in the preceding step, is in a position in which the upper opening thereof is associated with said breather nozzle 28 while the lower opening thereof is at said opening 25 for the inlet of the beverage from the bottle. Therefore, in this position we have the inlet of the beverage from the bottle into the decompression chamber 23, which was previously pressurized, through said inlet spout and due to this vacuum caused by the breather nozzle 28 present on the upper base of said main body 22.

The beverage enters said decompression chamber 23 in quantity proportional to the time it remained in this position.

In the third operating step, the decompression chamber 23 is in a position in which the lower base thereof is closed while the upper base is completely open and the beverage contained in the decompression chamber 23 is completely decompressed.

In the fourth and last step, said decompression chamber 23 is in a position in which both the upper and lower openings thereof are open. By being at said dispensing spout 26, the lower opening allows the dispensing of the beverage due to the force of gravity.

The invention claimed is:

1. A dispenser device for automatic dispensing apparatuses of carbonated beverages comprising a tap block comprising an inlet spout adapted to engage with an opening of a bottle or a vessel containing a beverage to be dispensed, the inlet spout comprising a first channel adapted to blow gas into the bottle or the vessel and a second channel adapted to extract the beverage from inside the bottle or the vessel, the first channel being associated to gas dispensing means by means of a valve, the second channel being associated with dispensing means of the beverage, the dispensing means comprising at least one decompression chamber associated with the second channel and with a dispensing spout, the at least one decompression chamber being adapted to vary the volume and/or inner pressure thereof, to introduce a given amount of the beverage therein and subsequently to dispense the beverage previously introduced therein by means of the dispensing spout, wherein the at least one decompression chamber is associated with the second channel by means of a first solenoid valve, is associated with the dispensing spout by means of a second solenoid valve and comprises a piston the movement of the piston within the at least one decompression chamber is adapted to vary the volume in the at least one decompression chamber.

2. The device according to claim 1, wherein the decompression chamber comprises a fifth solenoid valve adapted to rapidly lower the pressure inside the decompression chamber.

3. The device according to claim 1, comprising a plurality of decompression chambers, each of the plurality of decompression chambers being associated, by means of a solenoid valve, with a dispensing channel connected, in turn, to a dispensing spout by means of a further solenoid valve.

4. The device according to claim 1 comprising a multiple, rotating decompression chambers comprising: a main body, comprising, in turn, a plurality of decompression chambers arranged on the periphery of the main body, the main body being adapted to rotate about the axis thereof; a lower base associated with an inlet spout adapted to engage the opening of the bottle, to a gas inlet channel, to an opening for the introduction of the beverage from the bottle and to a dispensing spout; an upper base associated with a gas inlet channel and a breather nozzle, and further provided with at least one opening of size approximately corresponding to that of said decompression chambers.

5. The device according to claim 4 wherein the main body comprises four decompression chambers adapted to move through the following positions: a first position, corresponding to the gas inlet channel, wherein the decompression chamber is closed and is pressurized at a pressure value approximately equal to that in the bottle, a second position, wherein the pressurized decompression chamber is in a position in which an upper opening thereof is associated with the breather nozzle, while a lower opening thereof is at the opening for the introduction of the beverage from the bottle and the beverage from the bottle enters into the decompression chamber by effect of the vacuum caused by the breather nozzle on the upper base of the main body, a third position, wherein the decompression chamber is at a position in which the lower opening thereof is closed, while the upper opening thereof is open, and a fourth position, wherein the decompression chamber is at a position in which both the upper opening and the lower opening thereof are open and the lower opening is at the dispensing spout and allows the beverage to be dispensed by gravity.

6. A dispenser device for automatic dispensing apparatuses of carbonated beverages comprising a tap block comprising an inlet spout adapted to engage with an opening of a bottle or a vessel containing a beverage to be dispensed, the inlet spout comprising a first channel adapted to blow gas into the bottle or the vessel and a second channel adapted to extract the beverage from inside the bottle or the vessel, the first channel being associated to gas dispensing means by means of a valve, the second channel being associated with dispensing means of the beverage, the dispensing means comprising at least one decompression chamber associated with the second channel and with a dispensing spout, the at least one decompression chamber being adapted to appropriately vary the volume and/or inner pressure thereof, to introduce a given amount of the beverage therein and subsequently to dispense the beverage previously introduced therein by means of the dispensing spout, wherein the decompression chamber is associated with the second channel by means of a first solenoid valve, is associated with a dispensing spout by means of a second solenoid valve and comprises a third solenoid valve which connects the volume of the decompression chamber to the gas dispensing means, a fourth solenoid valve adapted to put an inside of the decompression chamber into communication with outside allowing a gradual lowering of the inner pressure of the decompression chamber.

7. The device according to claim 6, wherein the decompression chamber comprises a fifth solenoid valve adapted to rapidly lower the pressure inside the decompression chamber.

8. The device according to claim 6, comprising the plurality of decompression chambers, each of the plurality of decompression chambers being associated, by means of a solenoid valve, with a dispensing channel connected, in turn, to a dispensing spout by means of a further solenoid valve.

9. The device according to claim 6 comprising a multiple, rotating decompression chambers comprising: a main body, comprising, in turn, a plurality of decompression chambers arranged on the periphery of the main body, the main body being adapted to rotate about the axis thereof; a lower base associated with an inlet spout adapted to engage the opening of the bottle, to a gas inlet channel, to an opening for the introduction of the beverage from the bottle and to a dispensing spout; an upper base associated with a gas inlet channel and a dispensing nozzle, and further provided with at least one opening of size approximately corresponding to that of the decompression chambers.

10. The device according to claim 9 wherein the main body comprises four decompression chambers adapted to move through the following positions: a first position, corresponding to the gas inlet channel, wherein the first decompression chamber is closed and is pressurized at a pressure value approximately equal to that in the bottle, a second position, wherein the pressurized decompression chamber is in a position in which the upper opening thereof is associated with the breather nozzle, while the lower opening thereof is at the opening for the introduction of the beverage from the bottle and the beverage from the bottle enters into the decompression chamber by effect of the vacuum caused by the breather nozzle on the upper base of the main body, a third position, wherein the decompression chamber is at a position in which the lower opening thereof is closed, while the upper opening thereof is open, and a fourth position, wherein the decompression chamber is at a position in which both the upper opening and the lower opening thereof are open and the lower opening is at the dispensing spout and allows the beverage to be dispensed by gravity.

* * * * *